United States Patent [19]

Bouwkamp et al.

[11] 4,225,291

[45] Sep. 30, 1980

[54] FUEL INJECTION PUMP AND PLUNGER CONTROL MEANS THEREFOR

[75] Inventors: Gerald R. Bouwkamp, West Hartford; Charles W. Davis, Simsbury; Wesley B. Gilbert, Windsor; Charles J. Donahue, Enfield, all of Conn.

[73] Assignee: Stanadyne, Inc., Windsor, Conn.

[21] Appl. No.: 859,847

[22] Filed: Dec. 12, 1977

[51] Int. Cl.[3] ..... F04B 29/00; F04B 19/02

[52] U.S. Cl. ..... 417/214; 417/462

[58] Field of Search ..... 417/218, 294, 462, 214

[56] References Cited

U.S. PATENT DOCUMENTS

| | | | |
|---|---|---|---|
| 2,828,697 | 4/1958 | Roosa | 417/462 |
| 3,331,327 | 7/1967 | Roosa | 417/294 |
| 3,847,509 | 11/1974 | Bonin | 417/462 |
| 3,910,723 | 10/1975 | Bonin | 417/462 |
| 4,079,719 | 3/1978 | Varcoe | 417/218 |

FOREIGN PATENT DOCUMENTS

| | | | |
|---|---|---|---|
| 222948 | 1/1962 | Austria | 417/294 |

*Primary Examiner*—William L. Freeh

*Attorney, Agent, or Firm*—Prutzman, Kalb, Chilton & Alix

[57] ABSTRACT

Designs for variably controlling the maximum quantity of fuel which can be delivered by a pumping stroke of pumping plungers are disclosed. These include combinations of resilient and rigid leaf spring arrangements for controlling the maximum pumping stroke with and without speed responsive control valves or cams, to provide excess fuel for starting and for shaping the maximum fuel delivery curve according to speed.

40 Claims, 18 Drawing Figures

FUEL INJECTION PUMP AND PLUNGER CONTROL MEANS THEREFOR

The present invention relates to fuel pumps of the type employed for supplying sequential measured charges of fuel under high pressure to an associated internal combustion engine and more particularly to such a pump incorporating improved control means for controlling the pumping plungers thereof.

In a fuel pump of the type having reciprocating pumping plungers, it frequently is desirable to adjust and control the maximum output of the pump by means limiting the stroke of the plungers. It is also desirable to limit the maximum output stroke of the pumping plungers to a lesser level at low speeds than at high speeds to avoid the engine smoking.

Moreover, particularly where the output per pumping stroke is small, it is desirable to provide an arrangement which will provide additional fuel for starting so that when the engine is hot, and there is extra leakage past the pumping plungers, there will be sufficient fuel delivery to start the engine.

Finally, it is desirable to provide a control means which will provide for a gradually increasing maximum output of the pump above the idle speed range until the absolute stroke limit is reached.

A principal object of the present invention is to provide improved means for controlling the maximum stroke or displacement of the pumping plungers in a fuel injection pump at different levels under different engine operating conditions.

Another object of this invention is to provide an improved fuel injection pump having stroke control means wherein the maximum stroke of the pumping plungers is less at the idle speed range than at higher speeds. Included in this object is the provision of a pumping plunger stroke control means which gradually increases the maximum pumping stroke between idle speed level and a predetermined higher level.

Still another object of this invention is to provide an improved fuel injection pump having a pumping plunger stroke control means which provides additional fuel during cranking.

A further object of this invention is to provide such a control which is adjustable and which can be accurately and precisely set in a simple manner.

A still further object of the invention is to provide control means of the type referred to which is of simple and compact construction, so that it can be easily and simply fabricated and assembled, which will not interfere with or adversely effect the normal operation of the pump, and which will be sufficiently rugged to operate effectively over long periods of use without the need for adjustment.

Other objects will be in part obvious and in part pointed out more in detail hereinafter.

A better understanding of the invention will be obtained from the following detailed description and the accompanying drawings.

Figure 1:
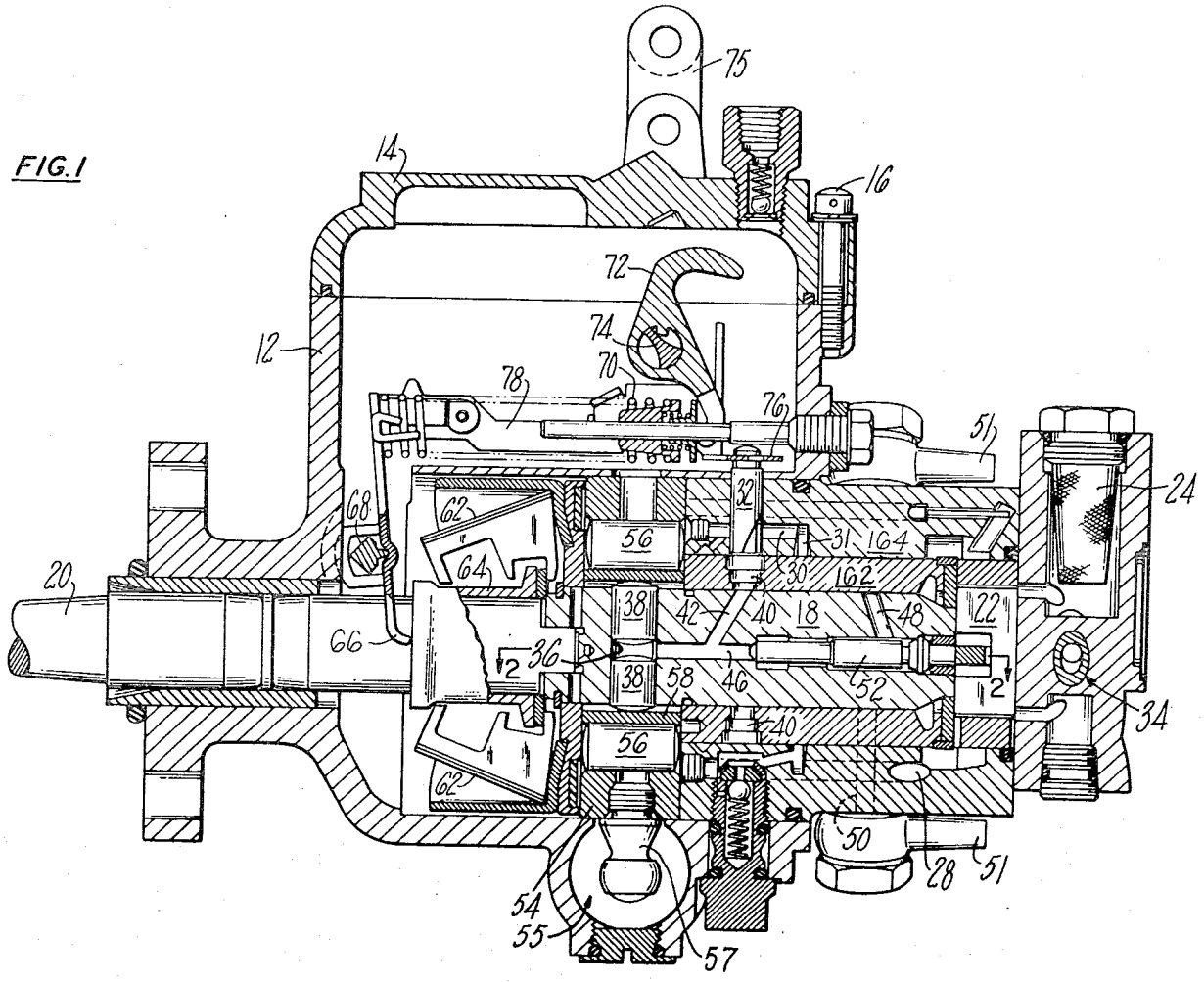
FIG. 1 is a longitudinal cross-sectional view, partly broken away, of a fuel injection pump suitable for the practice of the present invention.

Referring now to the drawings in detail, a fuel pump exemplifying the present invention is shown to be of the type adapted to supply sequential measured pulses or charges of fuel under high pressure to the several fuel injection nozzles of an internal combustion engine. The pump has a housing 12 provided with a governor chamber having a cover 14 secured thereto be fasteners 16. A fuel distributing rotor 18 having a drive shaft 20 driven by the engine is journaled in the housing.

A vane-type transfer or the low pressure supply pump 22 is driven by the rotor 18 and receives fuel from the reservoir (not shown) through pump inlet 24. Its output is delivered under pressure via axial passage 28, annulus 31 and passage 30 past a metering valve 32. A transfer pump pressure regulating valve, generally denoted by the numeral 34, regulates the output pressure of the transfer pump and returns excess fuel to the pump inlet 24. The regulator 34 is designed in a known manner to provide transfer pump output pressure which increases with engine speed in order to meet the increased fuel requirements of the engine at higher speeds and to provide a fuel pressure usable for operating auxiliary mechanisms of the fuel pump.

A high pressure charge pump comprising a pair of opposed plungers 38, mounted for reciprocation in a diametral bore 36 of the rotor, receives metered fuel from the metering valve 32 through a plurality of angularly spaced radial ports 40 (only two of which are shown) adapted for sequential registration with a diagonal inlet passage 42 of the rotor as the rotor 18 is rotated.

Fuel under high pressure from the charge pump is delivered through an axial bore 46 in the rotor to a distributing passage 48 which registers sequentially with a plurality of angularly spaced outlet passages 50 (only one of which is shown) which in turn communicate respectively with the individual fuel injection nozzles of the engine through discharge fittings 51 spaced around the periphery of the housing 12. A delivery valve 52 in the axial bore 46 operates to achieve sharp cut-off of fuel to the nozzles and to maintain a residual pressure in the downstream discharge passages.

The inlet passages 40 are angularly located around the periphery of the rotor 18 to provide sequential registration with the diagonal inlet passage 42 during the intake stroke of the plungers 38, and the outlet passages 50 are similarly located to provide sequential registration with the distributor passage 48 during the compression stroke of the plungers.

An annular cam ring 54 having a plurality of pairs of diametrically opposed cam lobes is provided for actuating the charge pump plungers 38 inwardly for pressurizing each charge of fuel. A pair of rollers 56 and roller shoes 58 are mounted in radial alignment with the plungers 38 for camming the plungers inwardly. For timing the distribution of fuel to the nozzles in correlation with engine operation, the annular cam ring 54 may be angularly adjustable by a suitable timing piston 55 which is connected to the cam ring by a connector 57.

A plurality of governor weigths 62 spaced about drive shaft 20 provide a variable bias on a sleeve 64, slidably mounted on drive shaft 20. The sleeve engages pivoted governor plate 66 to urge it clockwise (as viewed in FIG. 1) about a supporting pivot 68. The governor plate is urged in the opposite pivotal direction by a governor spring assembly 70, the bias of which is adjustable by a cam 72 operated by shaft 74 which is connected to the throttle arm 75.

The governor plate 66 is connected to control the angular position of the metering valve 32 through control arm 76 which is fixed to the metering valve and by a drive link 78 which is pivotally connected to control arm 76.

As well known, the quantity or measure of the charge of fuel delivered by the charge pump in a single pumping stroke is readily controlled by varying the restriction offered by the metering valve 32 to the passage of fuel. Thus, the angular position of the metering valve controls the speed of the associated engine and the centrifugal force of the governor fly weights may be used to urge the metering valve 32 in a direction to increase the restriction to the flow of fuel past the metering valve if speed begins to increase above the speed determined by equilibrium conditions for the opposing forces of the fly weights 62 and governor spring 70.

As indicated above, the amount of fuel delivered in a charge of fuel is normally determined by the setting of metering valve 32 and, in the past, the maximum output of the pump during a single pumping stroke under all conditions has been controlled by a simple adjustable spring arrangement such as curved leaf spring 84 (FIG. 4) of relatively heavy gauge secured to the rotor at its midpoint by a means of adjusting screw 86. The normal curvature of leaf spring 84 is slightly greater than that of the portion 88 of the rotor which it overlies so that the spring will bear against and fulcrum at the corners 90 of the rotor. The ends 94 of leaf spring 84 overlie the outer ends of shoes 58 to limit the outward movement thereof, and hence the maximum stroke of pumping plungers 38, thereby to limit the maximum quantity of fuel delivered by the pump during a pumping stroke. While leaf spring 84 is sufficiently rigid so that there is no appreciable flexing of the ends thereof by the impact of shoes 58, it is nonetheless sufficiently flexible so that it may be adjusted by adjusting screw 86 to fix the maximum travel of pumping plungers 38.

As herebefore indicated, it is desirable to provide different maximum outputs for the pump under different operating conditions and, in accordance with this invention, means are provided for controlling the maximum output of the pump under different conditions at different levels.

Figure 3:
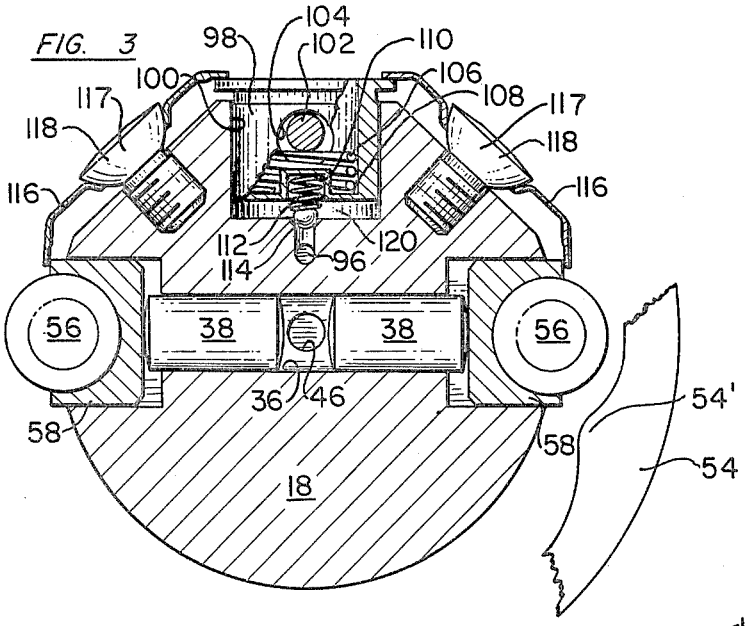
FIG. 3 is an enlarged fragmentary cross-sectional view of the rotor of the fuel injection pump of FIG. 1 taken along the lines 3—3 of FIG. 2 and illustrating a preferred embodiment of the present invention.

Referring now particularly to FIG. 3, there is illustrated a first preferred embodiment of the invention wherein the maximum pumping stroke of pumping plungers 38 is controlled to provide a longer pumping stroke during engine cranking than during other operating conditions. The embodiment of FIG. 3 also provides an arrangement whereby the pumping strokes or greater plunger displacement under certain engine operating conditions, such as of pumping plungers 38 are controlled to limit the maximum amount of fuel which can be delivered by the pump at a predetermined speed just above cranking, speed to an amount which gradually increases as speed increases above such predetermined speed.

Figure 2:
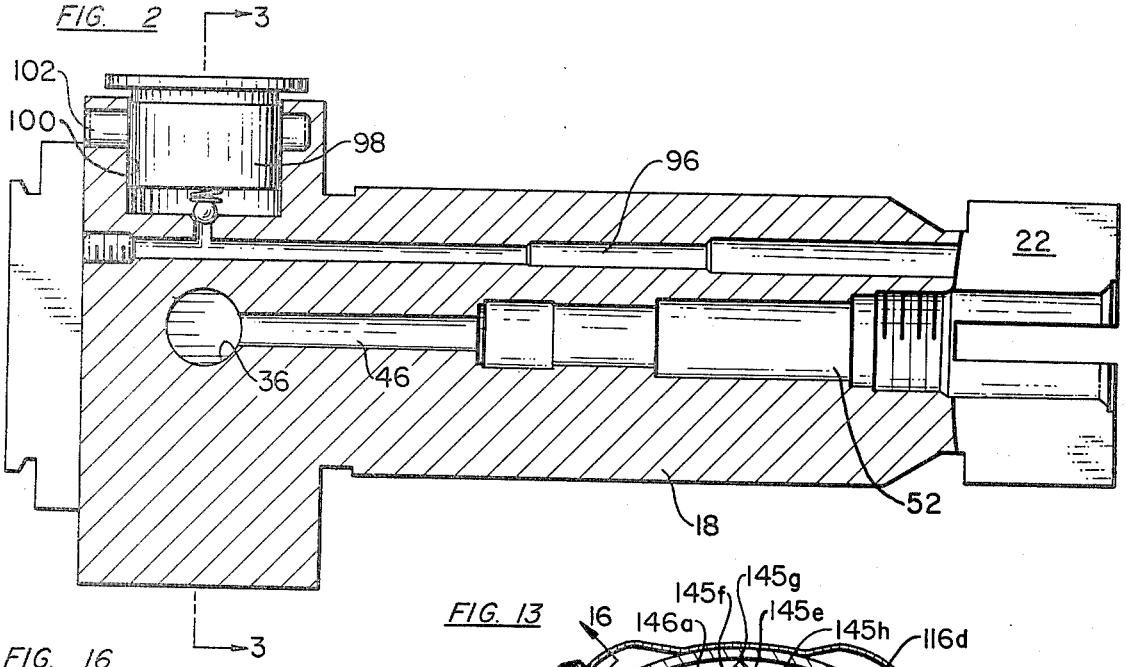
FIG. 2 is an enlarged fragmentary cross-sectional view of the rotor of the fuel injection pump of FIG. 1 taken along the lines 2—2.

As shown in FIG. 2, an axial passage 96 is formed in the rotor and is isolated from passage 46. Passage 96 is connected to the output of transfer pump 22 to receive fuel under pressure therefrom and to deliver the fuel to a control piston generally indicated at 98 to provide a control signal for actuating the control piston for purposes hereinafter more fully discussed.

The piston 98 is slidably mounted in a bore 100 and is secured therein by a pin 102 which passes through an enlarged opening 104 in the piston so that the piston may reciprocate a limited amount in bore 100. A control spring 106 (FIG. 3) engages the closed end wall 108 of piston 98 to bias the piston downwardly. Closed end wall 108 is provided with a cup-shaped recess 110 which serves as a spring seat for a biasing spring 112 of valve 114.

A pair of flexible leaf springs 116 mounted by a pair of mounting screws 118 have ends which respectively overlie the outer ends of roller shoes 58 and piston 98.

At low cranking speeds, the biasing force of spring 106 is sufficient to maintain piston 98 against its seat in opposition to transfer pressure in valve chamber 120, and leaf springs 116 may pivot to allow roller shoes 58 to move outwardly the maximum amount so that the maximum amount of fuel enters the pumping chamber between pump plungers 38.

After the engine starts and its speed is increased to a preselected level below idle speed, the pressure in chamber 120 will become sufficient to cause the piston to move the full amount allowed by the clearance between pin 102 and opening 104 where it will remain until the engine speed is again reduced to the preselected speed. Ball valve 114, biased by spring 112, serves as a check valve to prevent inward motion of piston 98 due to the forces generated by the plungers, rollers, and shoes. As illustrated in FIG. 3, spring 112 is a low force spring which permits ball valve to open so that transfer pressure may enter chamber 120 at a speed below the preselected speed. Leakage past control piston 98 will allow the piston to move to its inward position under the bias of spring 106 when the engine stops.

With piston 98 at its outer position, leaf springs 116 will pivot about screws 118 so that the end of leaf springs 116 overlying roller shoes 58 will limit the outward travel of plungers 38 to a lesser amount than when piston 98 was in its inner position during starting. However, since leaf springs 116 are flexible or yieldable under the impact forces generated by, the centrifugal force of plungers 38, rollers 56, and shoes 58, as well as the pressure of fuel between plungers 38, leaf springs 116 will deflect outwardly an increasing amount with increasing speed so that the maximum fuel delivered per pumping stroke may increase gradually as speed increases to provide a shaping of the maximum fuel delivery curve.

The bottom surface 117 of the heads of the adjusting screws 118 are spherical and engage mating spherical sockets of leaf springs 116. Moreover, by making the end of leaf spring 116 which overlies shoes 58 longer from the adjusting screw than the end which overlies control piston 98, the centrifugal force will maintain the end of the spring overlying shoes 58 outwardly to minimize the amount of repetitive contact therebetween and reduce wear.

Thus the embodiment of FIG. 3 provides an arrangement wherein the maximum plunger stroke during cranking is maximum, and wherein the maximum plunger stroke is reduced after starting at a speed just below the idle speed range with flexible leaf springs 116 serving to provide a limit of the maximum plunger strokes which increases as speed increases.

If desired, the embodiment of FIG. 3 can be modified so that the opening of ball valve 114 controls the preselected speed and spring 106 can be omitted.

Alternatively, the spring rate of spring 112 may be selected so that outward movement of piston 98 significantly reduces the force exerted on ball 114 by spring 112. This permits the system to operate so that the shift from high fuel delivery during starting to normal maximum fuel delivery occurs at a speed higher than idle speed, but the shift from normal maximum fuel dilivery to high fuel delivery for starting will not occur until speed has dropped below idle speed.

Figure 4:
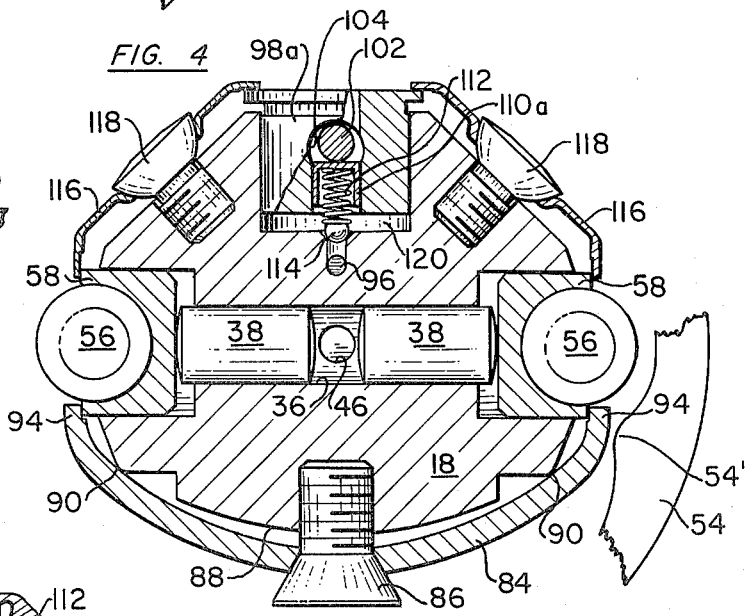
FIG. 4 is a cross-sectional view similar to FIG. 3 showing another preferred embodiment of the invention.

Referring now to FIG. 4 there is another embodiment of the invention which incorporates a single stiff spring 84 for limiting the maximum stroke of the pumping plungers to a fixed land under all operating conditions including cranking. This embodiment does not provide additional fuel during starting.

In the embodiment of FIG. 4, piston **98*a* does not have a return spring but rather relies upon the force exerted by pivoted leaf springs 116 about adjusting screws 118 and the engagement of shoes 48 with the springs to lever the piston downwardly against retaining pin 102. In this embodiment, seat 110*a* for control spring 112 of valve 114 is bottomed against retaining pin 102 so that the seating force on valve 114 is unchanged by the movement of control piston 98*a*. Outward or inward motion of piston 98** will occur at substantially the same speed and this speed must be below idle speed.

It will be noted that in the embodiment of FIG. 4, as well as in the embodiment of FIG. 3, valve 114 is maintained on its seat by spring 112 after the control piston **98*a* is actuated so that the pulsations of force due to the intermittent engagement of leaf springs 116 by shoes 58** will not cause the movement of the control piston.

Figure 5:
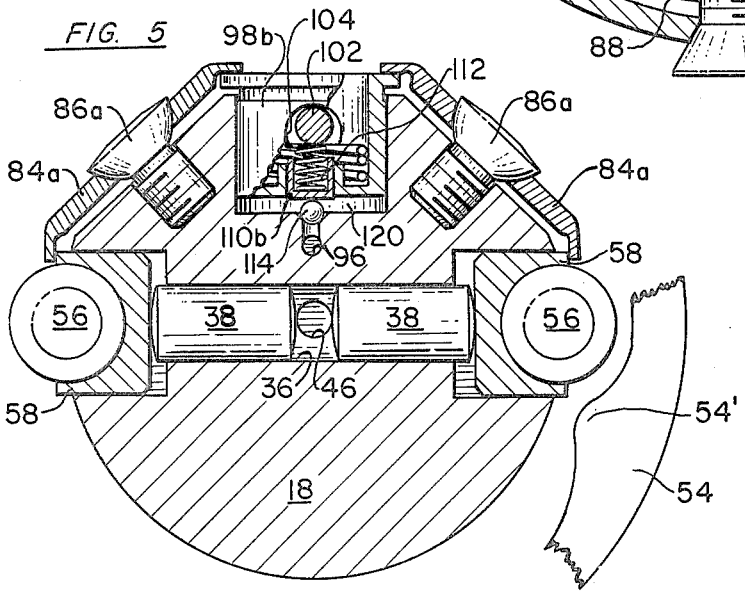
FIG. 5 is a cross-sectional view similar to FIG. 3 showing another preferred embodiment of the invention.

FIG. 5 illustrates another embodiment of the invention which provides additional fuel during engine cranking combined with a simple maximum limit of the fuel at all speeds above idling speed range. In this embodiment, a pair of relatively rigid leaf spring members **84*a* are provided to limit the outer movement of shoes 58 above the idle speed range. Spring members 84*a* are pivotably mounted on a pair of adjusting screws 86*a* and limit the pumping strokes of pumping plungers 38 at a single fixed level when control piston 98*b* is moved outwardly above idle speed range. Thus the embodiment of FIG. 5** provides an additional amount of fuel for starting which is greater than the maximum fuel which may be pumped during a pumping stroke after the engine initially reaches its operating speed range.

The illustrated control of this embodiment is similar to that of FIG. 4 except that the valve seat **110*b* is inverted with respect to control piston 98*b***.

Figure 6:
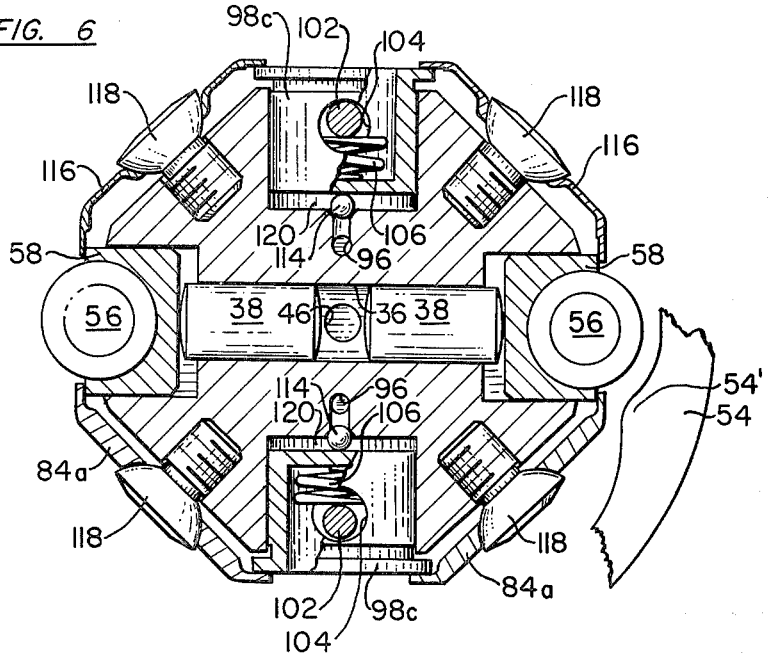
FIG. 6 is a cross-sectional view similar to FIG. 3 showing another preferred embodiment of the invention.

The embodiment of FIG. 6 is one which provides additional fuel for starting, a cutback of maximum plunger stroke at low speeds, with a gradually increasing maximum plunger stroke with speed until a predetermined level is reached, and a cut-out speed for high fuel delivery for starting that is higher than the cut-in speed.

As shown, under cranking conditions, control pistons **98*c* respectively hold the valves 114 against their seats under the bias of springs 106 which are seated against pin 102, and the ends of leaf springs 116 and 84*a*** permit the maximum outward travel of the pumping plungers.

After the engine is started and the speed rises to a predetermined level, the pressure in the passage 96 increases sufficiently to move the ball 114 off its seat so that the pressure can act on the entire surface of the control pistons **98*c* to snap the pistons to their outer operating position. Leaf springs 116 are adjusted so that they engage shoes 58 to limit the outward movement thereof to provide a second level of maximum stroke for plungers 38. Since the springs 116 can flex, this second level of maximum stroke gradually increases to a third level at which shoes 58 engage stiff spring member 84*a*** which establishes the maximum stroke for the plungers regardless of further increases in engine speed.

As shown, valves 114 are not provided with biasing springs after control pistons **98*c*** are actuated above idle speed.

Figure 14:
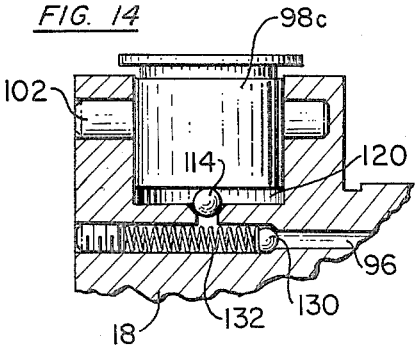
FIG. 14 is an enlarged fragmentary view showing a modified form of a valve suitable for the practice of the present invention.

Thus the valves will not serve to trap the fuel in chamber 120, and the pulsating forces applied when shoes 58 engage the leaf spring members 116 or **84*a*, respectively, may cause pistons 98*c* to move. As shown in FIG. 14, any such pulsating effect may be obviated by placing a valve 130 biased by a spring 132 against a seat at the end of passage 96 to trap the fluid contained in chamber 120**.

As previously described, leakage past pistons **98*c* will permit the pistons to move quickly under the bias of spring 106** when engine speed drops to a sufficiently low level, say 200 r.p.m. so as to return the maximum pumping stroke to the level desired for starting.

Figure 7:
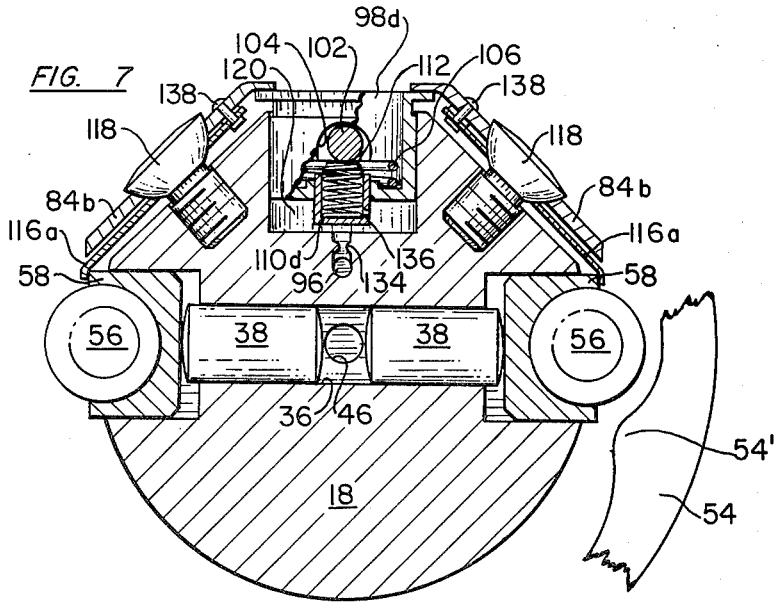
FIG. 7 is a cross-sectional view similar to FIG. 3 showing another preferred embodiment of the invention.

In the embodiment shown by FIG. 7, the control piston **98*d* is biased against stop pin 102 by control spring 106 during starting with spring 112 seated against the stop pin 102 to hold valve piston 110***d* in its lowermost position. In this regard, it will be noted that supply passage 96 communicates with chamber 120 through a fixed orifice 134 and that fuel is discharged from chamber 120 through a fixed orifice 136 in valve piston 110*d*. The area of orifice 134 is greater than that of orifice 136 so that, at a predetermined speed determined by the spring force of spring 112, the pressure on the end of control piston 110*d* will become sufficient to depress the spring 112 until orifice 136 is covered by control piston 98*d* to prevent further discharge of fuel from the chamber 120 and produce a snap action of control piston 98*d* to its outer position where it will remain until the engine is substantially stopped. The check valve arrangement shown in FIG. 14 should be included in passage 96 to prevent reverse flow from chamber 120.

In the embodiment of FIG. 7, flexible leaf spring 116*a* and rigid leaf spring 84*b* are formed as a unit secured together by a fastener 138 and are spaced apart in generally spaced relation as shown. Both leaf springs 116*a* and 84*b* are pivotally mounted on a single adjusting screw 118. With control piston 98*d* at its outer position (when speed reaches a predetermined level after starting) leaf spring 116*a* is held inwardly at a position to limit maximum plunger stroke to its lowest level. However, it is free to flex as the outward forces acting on shoes 58, rollers 56, and plungers 38 increase to provide a gradually increasing stroke limit for the plungers 38 until flexible leaf spring 116*a* bottoms against rigid leaf spring 84*b*. At that time, no further outward movement of the plungers 38 is permitted and a positive maximum stroke control is provide regardless of further increases in speed.

Figure 8:
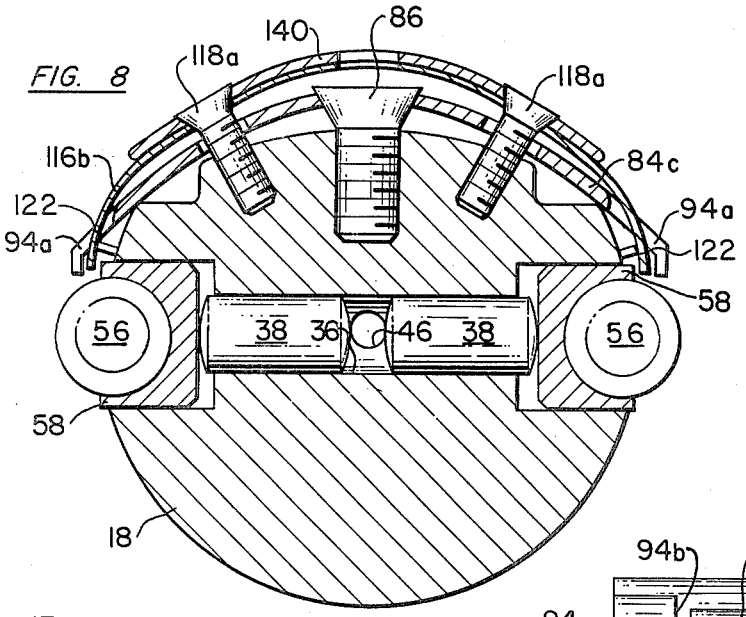
FIG. 8 is a cross-sectional view similar to FIG. 3 showing another preferred embodiment of the invention.
Figure 9:
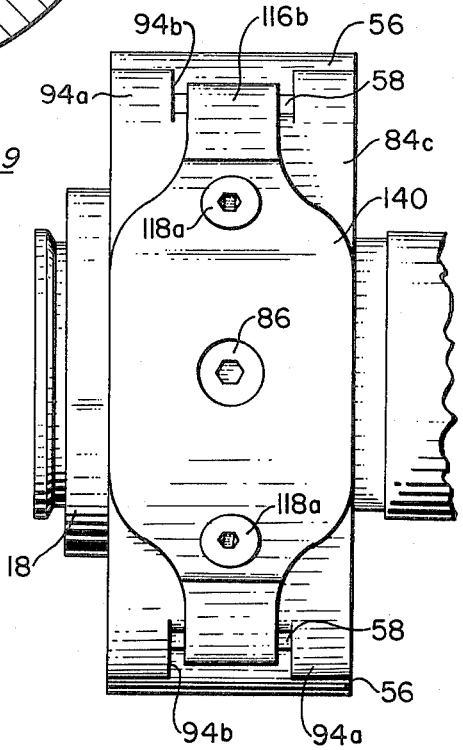
FIG. 9 is an enlarged fragmentary top view of the rotor of the embodiment of FIG. 8.

The embodiment of FIGS. 8 and 9 functions to provide a maximum stroke limit for plungers 38 under all operating conditions and speeds combined with a low speed maximum fuel cutback which gradually increases the stroke limit until the maximum stroke limit comes into effect at a predetermined speed. In this embodiment, relatively stiff leaf spring 84*c* is adjustable by adjusting screw 86 to space the outer ends 94*a* so as to provide a positive stroke limit at the predetermined speed in the same manner as the rigid leaf spring 84 of FIG. 4.

The ends 94*a* of leaf spring 84*c* are bifurcated to enable the ends of flexible leaf spring 116*b* to project through a central slot 94*b* thereof and overlie the ends of shoes 58 thereby to provide a low speed maximum fuel cutback which gradually increases the quantity of fuel delivered per pumping stroke until the ends of the shoes 58 engage the rigid stop 84*c*. In this design, a backing plate 140 is provided for resilient leaf spring 116*b* and a pair of adjusting screws 118*a* are positioned in apertures of backing plate 140 to secure the leaf spring to the rotor 18. Adjusting screws 118*a* are disposed at an angle to each other and preferably on a radius of rotor 18 so that, when adjusted, they change the curvature of backing plate 140 and flexible leaf spring 116*b* to adjust the positions of the ends of spring 116*b* thereby to limit the maximum stroke of plungers 38. Screws 118*a* make it possible to adjust the ends of spring 116*b* independently. Stops 122 limit the inward limit of movement of the ends of flexible leaf spring 116*b* regardless of the adjustment of adjusting screws 118*a* to set the minimum level of fuel delivery during cranking.

Figure 10:
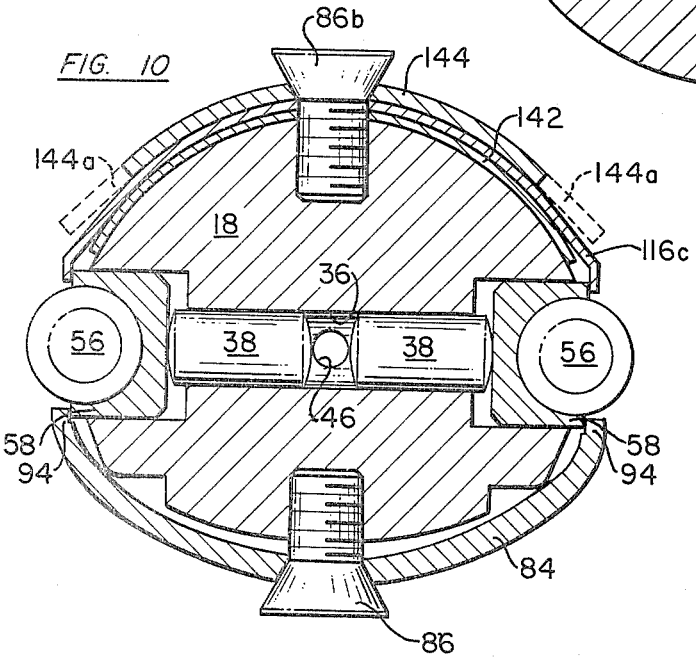
FIG. 10 is a cross-sectional view similar to FIG. 3 showing another preferred embodiment of the same invention.

The embodiment of FIG. 10 provides a maximum stroke limit for plungers 38 under all conditions in combination with a lower limit of the maximum stroke under low operating speeds with the lower limit gradually increasing until the maximum limit is reached. Ends 94 of rigid leaf spring 84 provide positive maximum limits for the stroke of pumping plungers 38 as determined by the adjustment of adjusting screw 86 as heretofore described in connection with FIG. 4. Flexible leaf spring 116*c* is mounted on the rotor by an adjusting screw 86*b* to limit maximum plunger travel under low speed conditions to a lesser amount than leaf spring 84. However, leaf spring 116*c* is flexible and is subject to outward deflection by impact by shoes 58 to gradually increase the maximum plunger stroke with increasing speed until shoes 58 engage leaf spring 84. Leaf spring 116*c* is held between a backup plate 144 and a shim 142 against which the free ends of leaf spring 116*c* bottoms to limit the inward movement of leaf spring 116*c*. The preload of leaf spring 116*c* is obtained by shaping spring 116*c* so that, in its free state, its curvature is greater than when installed. The effective rate of the leaf spring 116*c* may be adjusted the distance its ends extend beyond the ends of backup spring 144 and its own thickness. Backup plate 144 may be extended as indicated at 144*a* to thereby suddenly increase the effective stiffness of the flexible leaf spring 116*c* when it bottoms against backup plate so that it will substantially flex no further thereby eliminating the need for rigid spring 84.

Figure 11:
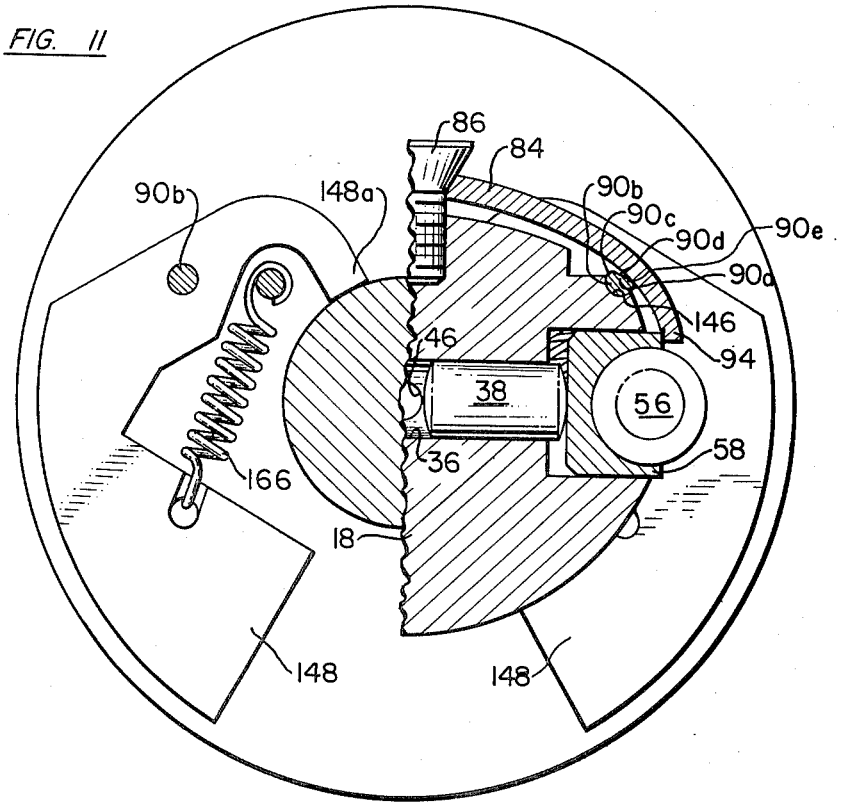
FIG. 11 is a cross-sectional view generally similar to FIG. 3 showing another preferred embodiment of the invention.
Figure 12:
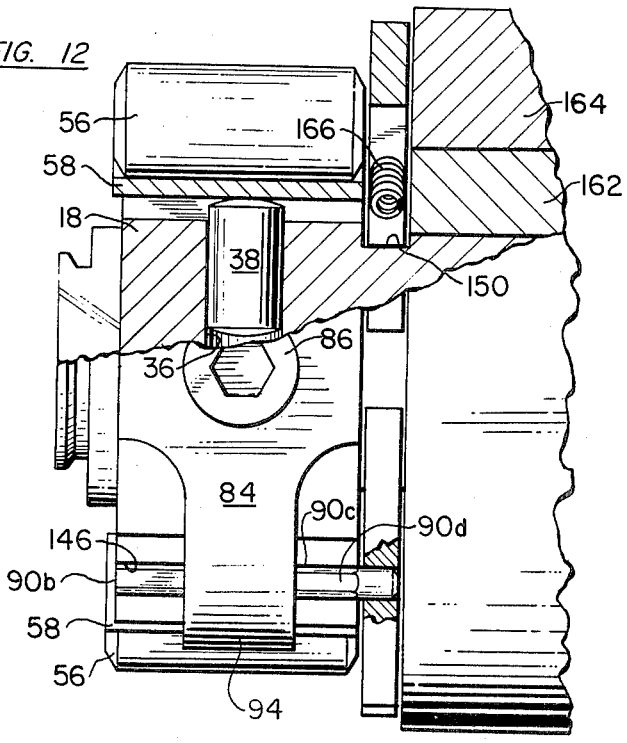
FIG. 12 is an enlarged fragmentary top view of the rotor of the embodiment of FIG. 11.

FIGS. 11 and 12 illustrate another modified form of the invention which provides a positive maximum limit of pumping stroke under all speed conditions combined with a lower but gradually increasing stroke limit until the positive maximum limit is reached. This embodiment also provides additional fuel for starting.

As illustrated in FIG. 11, relatively stiff leaf spring member 84 is adjusted by adjusting screw 86 in the same manner as in FIG. 4 so that the ends 94 thereof provide positive stops for the maximum outward movement of plungers 38 in the same manner as heretofore described in connection with FIG. 4. In this embodiment however, the fulcrum is not fixed as in the embodiment of FIG. 4 but rather comprises a rotary cam 90*a*, formed on shaft 90*b*, which deflects the outer ends 94 of the leaf spring 84 in accordance with centrifugal force. As shown, a pair of shafts 90*b* journalled in a pair of cylindrical grooves 146 of the rotor 18 are secured to a pair of fly weights 148 to rotate therewith.

As shown in FIG. 12, fly weights 148 are positioned in an annular groove 150 interposed between rollers 56 and sleeves 162, 164 of the pump. Biasing springs 166 are provided to urge fly weights 148 in opposition to centrifugal force. During cranking, when engine speed is low, springs 166 urge the fly weights toward the axis of rotation so that the edge 90*c* of flat 90*d* on the shaft engages the inner surface of leaf spring 84 to hold the ends 94 of the leaf spring 84 outward to increase the pumping stroke. At a predetermined speed, centrifugal force begins to overcome the force of springs 166 to rotate shafts 90*b* so that leaf springs 84 engages flats 90*d* to decrease the maximum pumping stroke of plungers 38. Further rotation of shafts 90*b* causes edge 90*e* to engage leaf spring 84 and the resultant outward movement of the ends 94 of leaf spring 84 continues until ends 148*a* of fly weights 148 bottom in groove 140 to provide a maximum outer limit for the travel of roller shoes 58 and pumping plungers 38. The schedule of stroke relative to speed may be adjusted by adjusting screw 86, the width of flat 90*d*, the force of spring 166, and the shape and mass of fly weights 148.

Figure 13:
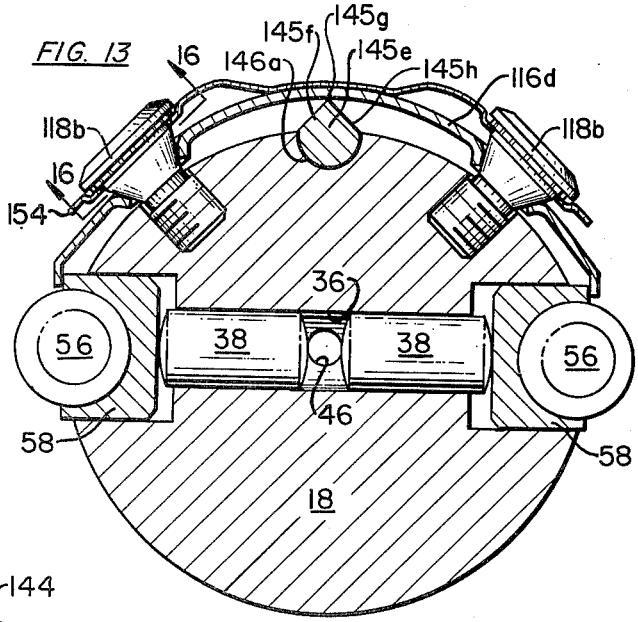
FIG. 13 is a cross-sectional view similar to FIG. 3 showing another preferred embodiment of the invention.

FIG. 13 shows another modification of the invention somewhat similar to that of FIGS. 11 and 12 wherein a single fly weight is utilized to provide the same functions. In this embodiment, a single shaft 145*e*, journaled in a cylindrical groove 146*a* provided in rotor 18, is rotated by a single fly weight 148 having a biasing spring 166. Shaft 145*e* is disposed midway between a pair of adjusting screws 118*b* so as to change the curvature of the leaf spring 116*d* as shaft 145*e* rotates. During cranking, shaft 145*e* is rotated so that its surface 145*f* engages flexible leaf spring 116*d*. This permits the ends of flexible leaf spring 116*d* to become spaced further apart to allow a longer pumping stroke of plungers 38. After the engine starts and reaches a speed above the idle speed range, the fly weight will rotate shaft 145*e* until it reaches the position where edge 145*g* engages leaf spring 116*d* to limit the maximum pumping stroke of pumping plungers 38 to the lowest level. Thereafter, as speed increases and shaft 145*e* rotates further in a counterclockwise direction (as viewed in FIG. 13), the ends of leaf spring 116*d* are gradually spaced further apart until the flat 145*h* of shaft 145*e* engages leaf spring 116*d* so that an increased maximum pumping stroke is again obtained.

Since adjusting screws 118*b* may be adjusted independently, the ends of leaf spring 116*d* may be each adjusted to balance the pumping strokes of plungers 38.

Figure 16:
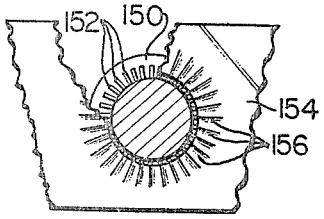
FIG. 16 is a bottom view of the adjusting screw of FIG. 15, taken generally along line 16—16 of FIG. 13.
Figure 15:
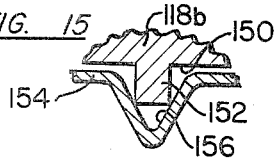
FIG. 15 is an enlarged elevational view showing a preferred form of a latching arrangement for the spring adjusting screws utilized in the practice of the invention.

FIGS. 13, 15, and 16 illustrate an arrangement for securing the adjusting screws 118*b* for the leaf spring members so that they are positively secured but are nonetheless readily adjustable, if desired. As shown, a bottom surface 150 of adjusting screws 118*b* is provided with a plurality of detents 152 and the upper surface of a retaining spring 154 is provided with a plurality of notches 156 so that by depressing retaining spring 154 and rotating screw 118*b*, the ends of leaf spring member 116*d* may be changed and the release of retaining spring 154 causes detents 152 and notches 156 to latch to prevent the inadvertent rotation of the adjusting screw in use.

Figure 17:
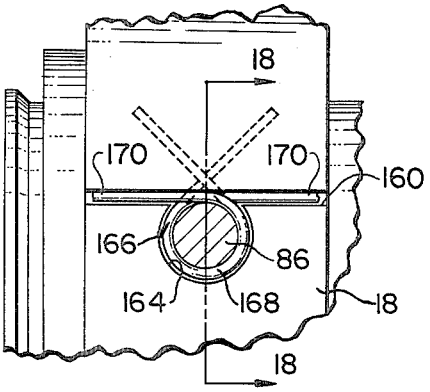
FIGS. 17 and 18 illustrate another arrangement for latching the spring adjusting screws.
Figure 18:
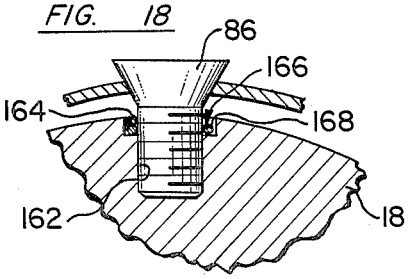

FIGS. 17 and 18 illustrate an alternative embodiment for releasably securing an adjusting screw against inadvertent movement. As shown, a slot 160 may be milled in the periphery of the rotor so as to intersect the threaded bore 162 for an adjusting screw, say screw 86. The bore 162 is also provided with a counterbore 164, intersecting the slot 160. A wire fastener 166 having a single circular convolution 168 is positioned around the adjusting screw and, when the screw is adjusted, the ends 170 of the fastener are flexed for a relaxed position, as shown in dotted lines, to reduce the diameter of the convolution 168 and are depressed into slot 160 to frictionally grip the screw to secure the same.

It will be apparent that the different features illustrated in connection with the several embodiments of the invention disclosed above may be utilized and incorporated in other embodiments as desired.

As will be apparent to persons skilled in the art, various modifications, adaptations and variations of the foregoing specific disclosure can be made without departing from the teachings of the present invention.

We claim:

1. A fuel injection pump comprising a rotor having a transverse bore, pumping means including a plunger in said bore, actuating means for powering said pumping means to cause the pumping means to pressurize pulsed charges of fuel, and means for limiting the maximum stroke of the pumping means comprising a leaf spring member attached to the rotor with one end overlying said pumping means and engageable thereby to provide a stop limiting the outward movement of the said pumping means, said leaf spring member being rigid under the forces imposed thereon by said pumping means during a first speed range extending up to a predetermined intermediate speed within the operating range of the pump to limit the maximum pumping stroke to a fixed level within said first speed range, said leaf spring member exerting a spring force which is less than the opposing force exerted thereon by said pumping means during a second speed range above said intermediate speed to flex the leaf spring increasingly with increasing speed to increase the maximum pumping stroke gradually as speed increases within said second speed range.

2. The fuel injection pump of claim 1 including an adjusting screw for adjusting said leaf spring member and resilient gripping means surrounding said screw to frictionally grip the same, said gripping means being non-rotatably secured to said rotor.

3. The fuel injection pump of claim 1 including means for pivotally mounting said leaf spring member on the rotor.

4. The fuel injection pump of claim 3 including stop means for limiting the pivotal movement of said leaf spring member.

5. A fuel injection pump comprising a rotor having a transverse bore, pumping means including a plunger in said bore, actuating means for powering said pumping means to cause the pumping means to pressurize pulsed charges of fuel, means for limiting the maximum stroke of the pumping means comprising a flexible leaf spring member attached to the rotor with one end overlying said pumping means to limit the outward movement thereof, said leaf spring member being engageable by said pumping means and being yieldable under the forces thereon to increase the maximum pumping stroke gradually as speed increases, and a rigid backing spring which overlies said yieldable leaf spring member and extends toward said one end thereof to fix its spring rate.

6. The fuel injection pump of claim 5 including a spacer to fix the radial distance at which said one end of said yieldable leaf spring member is engageable by said pumping means.

7. The fuel injection pump of claim 5 wherein the end portion of said rigid leaf spring member is spaced from said one end of said yieldable leaf spring member, and said one end bottoms against the end of said rigid leaf spring member to fix the maximum pumping stroke regardless of speed.

8. A fuel injection pump comprising a rotor having a transverse bore, pumping means including a plunger in said bore, actuating means for powering said pumping means to cause the pumping means to pressurize pulsed charges of fuel, means for limiting the maximum stroke of the pumping means comprising a flexible leaf spring member attached to the rotor with one end overlying said pumping means to limit the outward movement thereof, said leaf spring member being engageable by said pumping means and being yieldable under the forces thereon to increase the maximum pumping stroke gradually as speed increases, and control means for moving said one end of said stroke limiting means to a second position automatically at a predetermined speed.

9. The fuel injection pump of claim 8 including means for generating a hydraulic pressure correlated with speed and means for subjecting said control means to said hydraulic pressure for actuating said control means at said predetermined speed.

10. The fuel injection pump of claim 9 wherein said control means includes one area subjected to said hydraulic pressure until said predetermined speed is reached and a larger area subjected to said hydraulic pressure after said predetermined speed is reached to maintain said control means in its second radial position until the pump is substantially stopped.

11. The fuel injection pump of claim 9 wherein said control means is a piston having a chamber at one end thereof for receiving the output of said pressure generating means through a first orifice, said chamber having a second orifice of smaller size than said first orifice for discharging the pressure from said chamber, and means for closing said second orifice when said predetermined speed is reached.

12. The fuel injection pump of claim 9 including a one-way valve for preventing reverse flow to said pressure generating means from said chamber.

13. The fuel injection pump of claim 8 wherein said control means comprises a rotatable fulcrum having camming surfaces engaging said leaf spring member and a flyweight for actuating the same, to shift said one end of said yieldable leaf spring member to different radial positions according to speed.

14. The fuel injection pump of claim 13 wherein said fulcrum gradually shifts said one end to increase the maximum pumping stroke as speed increases above a predetermined speed.

15. The fuel injection pump of claim 13 wherein said fulcrum shifts said one end to a greater radial position during cranking than at a predetermined speed.

16. The fuel injection pump of claim 15 wherein said flyweight includes a stop for limiting the maximum pumping stroke to a fixed maximum level regardless of speed.

17. The fuel injection pump of claim 13 wherein said leaf spring member is secured to said rotor by a pair of peripherally spaced screws, and said fulcrum is positioned intermediate said screws to shift the radial position of said one end with speed.

18. The fuel injection pump of claim 17 wherein said fulcrum cams said one end of said leaf spring member to a position providing a maximum pumping stroke at cranking speed, then gradually decreasing the maximum pumping stroke until a predetermined speed is reached and thereafter gradually increasing the maximum pumping stroke.

19. A fuel injection pump comprising a rotor having a transverse bore, pumping means including a plunger in said bore, actuating means for powering said pumping means to cause the pumping means to pressurize pulsed charges of fuel, means for limiting the maximum stroke of the pumping means comprising a flexible leaf spring member attached to the rotor with one end overlying said pumping means to limit the outward movement thereof, said leaf spring member being engageable by said pumping means and being yieldable under the forces thereon to increase the maximum pumping stroke gradually as speed increases, and a second leaf spring member having one end overlying said pumping means being engageable by said pumping means, said second leaf spring member being substantially rigid to limit the maximum pumping stroke at a fixed level.

20. The fuel injection pump of claim 19 including control means for disabling a second leaf spring member from limiting said maximum pumping stroke at said fixed level until said predetermined speed is reached.

21. The fuel injection pump of claim 20 including means for pivotally mounting said second leaf spring member, and wherein said disabling control means is actuated at said predetermined speed to fix the position of said one end of said second leaf spring member to establish the maximum stroke at said fixed level.

22. A fuel injection pump comprising a rotor having a transverse bore, pumping means including a plunger in said bore, actuating means for powering said pumping means to cause the pumping means to pressurize pulsed charges of fuel, means for limiting the maximum stroke of the pumping means comprising a flexible leaf spring member attached to the rotor with one end overlying said pumping means to limit the outward movement thereof, said leaf spring member being engageable by said pumping means and being yieldable under the forces thereon to increase the maximum pumping stroke gradually as speed increases, the other end of said yieldable leaf spring member is secured to a rigid leaf spring member with said one end thereof being spaced from said fixed spring member to limit the maximum pumping stroke at a fixed level when said yieldable spring member bottoms against said rigid leaf spring member.

23. The fuel injection pump of claim 22 including a control means which disables said leaf spring members until a predetermined speed is reached.

24. A fuel injection pump comprising a rotor having a transverse bore, pumping means including plunger in said bore, actuating means for powering said pumping means to cause the pumping means to pressurize pulsed charges of fuel, means for limiting the maximum stroke of the pumping means comprising a flexible leaf spring member attached to the rotor with one end overlying said pumping means to limit the outward movement thereof, said leaf spring member being engageable by said pumping means and being yieldable under the forces thereon to increase the maximum pumping stroke gradually as speed increases, and a second leaf spring member overlying the first leaf spring member and having an end overlying said pumping means to limit the outward movement thereof independently of the first, said end of said second leaf spring member being positioned a greater radial distance than said end of said first leaf spring member, said second leaf spring member being rigid to fix the maximum pumping stroke at all speeds.

25. The fuel injection pump of claim 24 wherein the ends of said leaf spring members are independently adjustable.

26. The fuel injection pump of claim 24 wherein said end of one of said leaf spring members is bifurcated and said end of said other leaf spring member extends therethrough.

27. A fuel injection pump comprising a rotor having a transverse bore, pumping means including a plunger in said bore, actuating means for powering said pumping means to cause the pumping means to pressurize pulsed charges of fuel, means for limiting the maximum stroke of the pumping means comprising a flexible leaf spring member attached to the rotor with one end overlying said pumping means to limit the outward movement thereof, said leaf spring member being engageable by said pumping means and being yieldable under the forces thereon to increase the maximum pumping stroke gradually as speed increases, and an adjusting screw for adjusting said leaf spring member, and mating detent means, non-rotatably secured to said adjusting screw and said leaf spring member, for releasably securing the screw in adjusted position.

28. A fuel injection pump for supplying charges of fuel sequentially to an internal combustion engine comprising a rotor having a transverse bore, pumping means including a plunger in said bore, actuating means for powering said pumping means to cause the pumping means to pressurize pulsed charges of fuel, means for limiting the maximum movement of the pumping means comprising a leaf spring member attached to the rotor with one end overlying and engageable with said pumping means to limit the maximum pumping stroke thereof, and control means engageable with said leaf spring member and responsive to a change in an engine operating condition for adjusting said one end of the leaf spring member to a first radial position under one engine operating condition and for shifting said one end to a second and different radial position upon a change in said engine operating condition.

29. The fuel injection pump of claim 28 wherein said leaf spring member is yieldable under the impact forces imposed thereon by said pumping means to increase the maximum pumping stroke gradually as engine speed increases.

30. The fuel injection pump of claim 28 wherein said control means shifts said one end of said leaf spring member to said second radial position when speed increases to above the idle speed range, said second radial position being less distance from the axis of rotation than said first radial position.

31. The fuel injection pump of claim 28 including a resilient latching spring overlying said leaf spring member, said latching spring and said screw being provided with mating latching means for releasably securing the screw in adjusted position.

32. The fuel injection pump of claim 28 including means for generating a hydraulic pressure indicative of said change in engine operating condition and means for subjecting said control means to said hydraulic pressure for actuating said control means at said different engine operating condition.

33. The fuel injection pump of claim 32 wherein said control means includes one area which is subject to said hydraulic pressure until said changed engine operation condition is reached and a larger area which is subject to said hydraulic pressure thereafter to maintain said one end in its second radial position until the pump is substantially stopped.

34. The fuel injection pump of claim 32 wherein said control means is a piston having a chamber at one end thereof for receiving the output of said pressure generating means through a first orifice, said chamber having a second orifice of smaller size than said first orifice for discharging the pressure from said chamber, and means for closing said second orifice when said changed engine operating condition is reached.

35. The fuel injection pump of claim 32 including a one-way valve for preventing reverse flow toward said pressure generating means from said chamber.

36. The fuel injection pump of claim 28 including means for pivotally mounting said leaf spring member on the rotor.

37. The fuel injection pump of claim 36 including stop means for limiting the pivotal movement of said leaf spring member.

38. The fuel injection pump of claim 28 wherein the pumping stroke limiting means comprises a plurality of leaf spring members attached to the rotor with each leaf spring member having one end overlying said pumping means to limit the maximum outward movement thereof and at least some of said leaf spring members are rigid to limit the maximum pumping stroke at substantially a fixed level while the engine is operating under said changed engine operating condition.

39. The fuel injection pump of claim 38 wherein at least some of said leaf spring members are yieldable under the impact forces imposed thereon by said pumping means to increase the maximum pumping stroke gradually as speed increases as the engine speed increases.

40. The fuel injection pump of claim 39 wherein some of said leaf spring members are rigid to limit the maximum pumping stroke at substantially a fixed level while the engine is operating under said changed engine operating condition.

* * * * *